United States Patent [19]

Axelrod

[11] Patent Number: 5,029,900

[45] Date of Patent: Jul. 9, 1991

[54] WRAP-AROUND COVER FOR A BOUND BOOK

[76] Inventor: Herbert R. Axelrod, 6 Marine Pl., Deal, N.J. 07723

[21] Appl. No.: 426,527

[22] Filed: Oct. 26, 1989

Related U.S. Application Data

[63] Continuation of Ser. No. 170,983, Mar. 21, 1988, abandoned.

[51] Int. Cl.[5] ..... B42D 3/04; B42D 3/00; B42D 3/02; B42D 3/06

[52] U.S. Cl. ..... 281/34; 281/32; 281/31; 281/29

[58] Field of Search ..... 281/29, 31, 32, 33, 281/34, 35, 41; 425/396

[56] References Cited

U.S. PATENT DOCUMENTS

| | | | |
|---|---|---|---|
| 2,641,484 | 6/1953 | Brody | 281/34 |
| 3,024,496 | 3/1962 | Colombo | 425/396 |
| 3,483,965 | 12/1969 | Rosenblatt et al. | 281/34 |
| 3,891,240 | 6/1975 | Du Corday | 281/29 |
| 4,274,659 | 6/1981 | D'Ambrosio | 281/34 |
| 4,519,630 | 5/1985 | Holmes | 281/31 |
| 4,527,814 | 7/1985 | Carter et al. | 281/34 |
| 4,577,890 | 3/1986 | Boyett | 281/34 |
| 4,715,619 | 2/1987 | Sloot | 281/32 |

*Primary Examiner*—Douglas D. Watts
*Assistant Examiner*—Paul M. Heyrana, Sr.
*Attorney, Agent, or Firm*—Fulwider Patton Lee & Utecht

[57] ABSTRACT

A wrap-around cover for a bound book which includes a rectangular sheet having a center portion that abuts the book spine, with the side portions of the sheet being folded inwardly to overlie the front and rear covers of a book to be protected, and with the distal portions of the rectangular sheet being formed with inwardly-facing flaps. These flaps receive the outer portions of the front and rear covers of the book to removably retain the wrap-around cover on the book, and with the wrap-around cover being formed of a flexible synthetic plastic material so printing on the front and rear book covers is visible.

4 Claims, 4 Drawing Sheets

FIG. 16
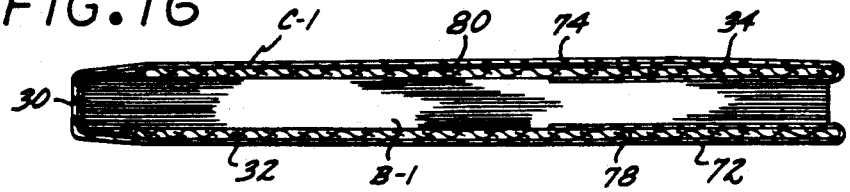
FIG. 17
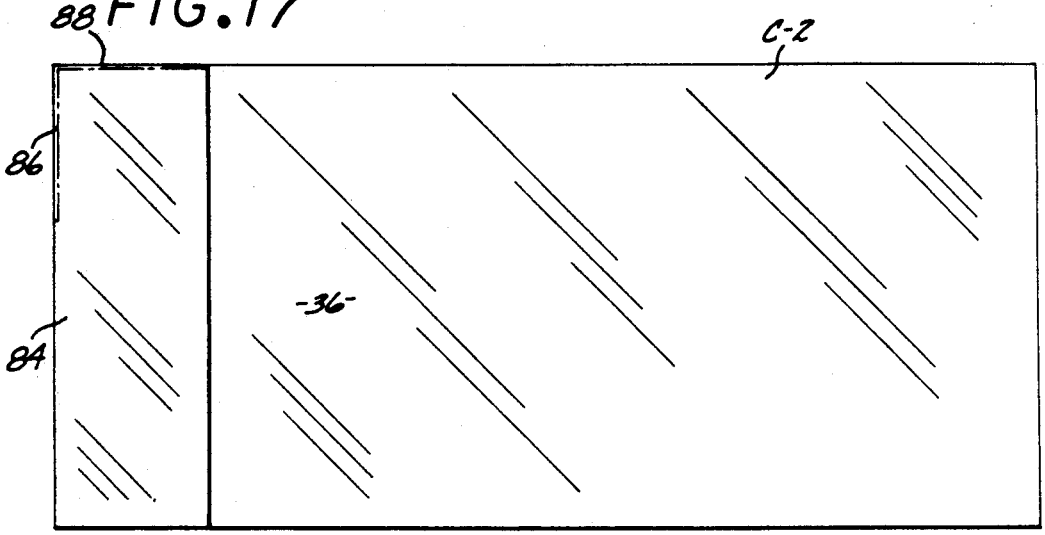
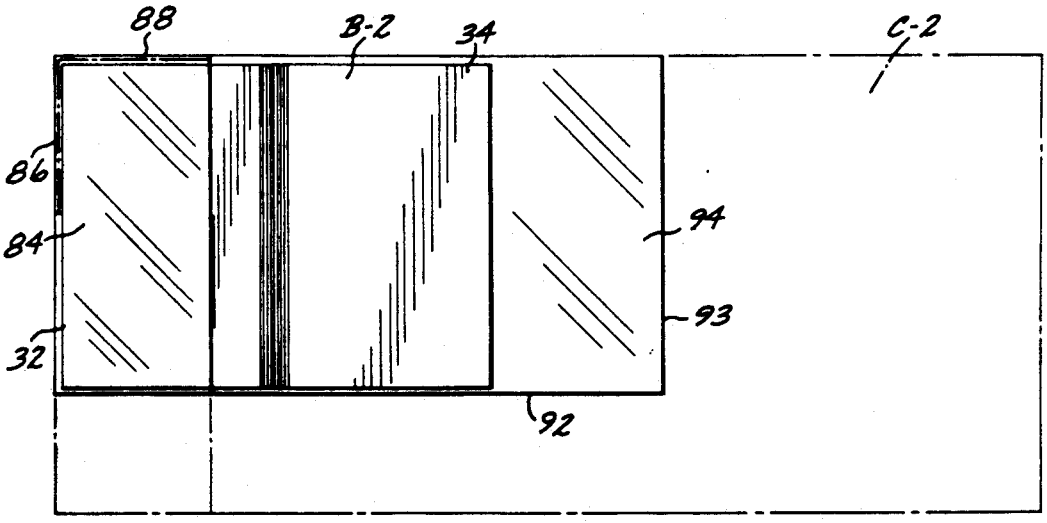
FIG. 18
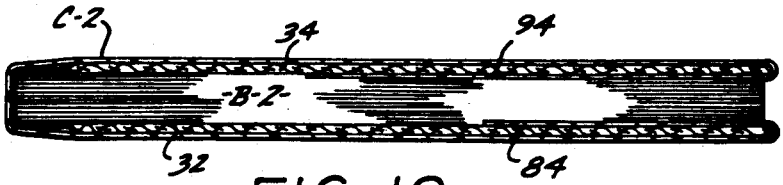
FIG. 19

WRAP-AROUND COVER FOR A BOUND BOOK

This is a continuation of copending application(s) 07/170,983 field on 3/21/88 now abandoned.

BACKGROUND OF THE INVENTION

The present invention relates to a protective cover for a bound book.

When books are shipped they often undergo damage which renders them unsaleable, this is particularly true of paperback books. Books are also frequently damaged while they are on display in a bookstore. Damage commonly occurs when books sold to a bookstore are returned to the publisher. Book damage generally involves scuffing and bending of the book covers. Book covers, additionally undergo fading while on display through exposure to ultraviolet light. Moreover, it often occurs that plastic laminations incorporated in the book covers of paperback books cause curl and warp. The aforementioned damage is particularly acute with respect to paperback books sold to pet shops, since the interiors of the pet shops in which the books are displayed exist at a high humidity level and contain excess dust from the feathers of birds, animals and pet food.

When books are shipped to libraries, the libraries frequently provide the books with protective plastic or paper covers. Such covers are generally larger in dimension than the books they are to protect, since libraries limit their cover inventory by stocking large sizes to fit many sizes of books. These covers must be manually cut and fitted to the books to be fitted. It is the general practice of libraries to purchase a separate card envelope to glue inside the front page of each book to receive a library card. Hand-fitting the covers to the books and gluing the card envelopes thereto requires considerable time and cost to prepare a book for use by the library patrons.

SUMMARY OF THE INVENTION

The primary object of the present invention is to provide a wrap-around cover for a bound book which substantially eliminates damage to such book during shipping, display and book returns to the book source.

Another object of the present invention is to provide a wrap-around cover for a bound book wherein a single size cover may be fitted to several sizes of books in a simple and expedient manner.

Another object of the present invention is to provide a wrap-around cover for a bound book which incorporates one or more integral pockets for receiving a library card or the like.

A further object of the present invention is to provide a wrap-around cover for a bound book formed of transparent material whereby printing on the front and rear covers of the covered book are visible through the wrap-around cover.

Yet a further object of the present invention is to provide a wrap-around cover for a bound book which will prevent damage to the book due to exposure to ultraviolet light.

Another object of the present invention is to provide a wrap-around cover for a bound book which is of ribbed configuration to thereby produce a bulkier feeling, enabling the use of a relatively thin cover material, and also to permit the cover to better absorb shocks during shipment of the book.

A more particular object of the present invention is to provide a wrap-around cover for a bound book which includes a rectangular sheet having a center portion which abuts the book spine with the side portions of the sheet being folded inwardly to overlie the front and rear covers of a book to be protected, and with the distal portions of the rectangular sheet being formed with inwardly-facing flaps which receive the outer portions of the front and rear covers of the book to removably retain the wrap-around cover on the book, and with the wrap-around cover being formed of a flexible synthetic plastic material.

BRIEF DESCRIPTION OF THE DRAWINGS

These and other objects and advantages of the present invention will become apparent from the following detailed description, with reference to the accompanying drawings wherein:

FIG. 16 is an enlarged top plan view of a thicker book provided with the adjustable wrap-around book cover of FIGS. 13-15;

FIG. 17 is a view similar to FIG. 7 showing a fifth form of wrap-around cover embodying the present invention;

FIG. 18 is a front view showing how the cover of FIG. 17 is dimensioned to fit a book;

FIG. 19 is a top plan view in enlarged scale showing the wrap-around cover of FIG. 17 and 18 as applied to a book to be protected;

DESCRIPTION OF PREFERRED EMBODIMENTS

Figure 1:
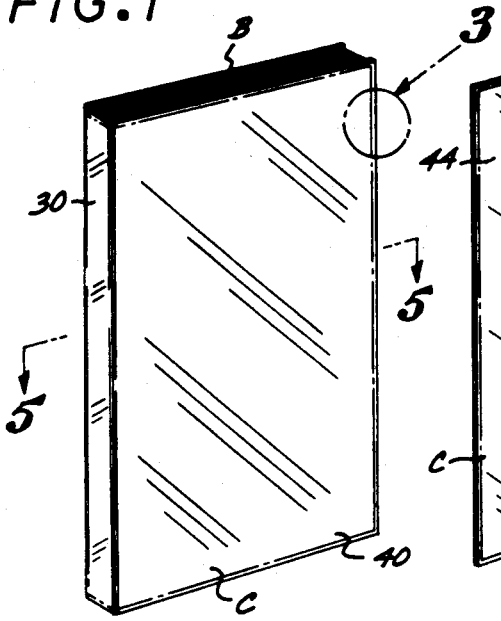
FIG. 1 is a perspective view of a bound book upon which is arranged a wrap-around cover embodying the present invention, the book being shown in a closed position.
Figure 2:
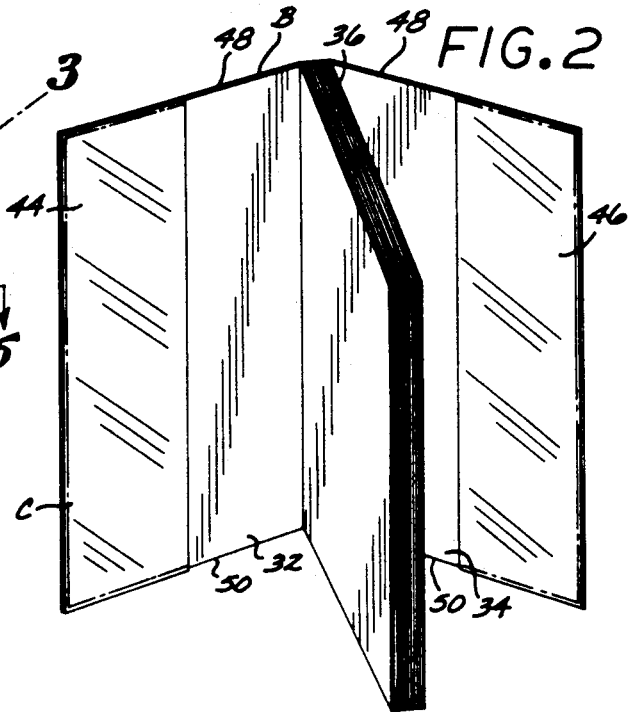
FIG. 2 is a perspective view similar to FIG. 1 but showing the front and rear covers of the book in an open position.

Referring to the drawings and particularly FIGS. 1-7, there is shown a first form of wrap-around cover C for a bound book B. The book includes a vertically extending spine 30, a front cover 32, a rear cover 34 and a plurality of pages 36 which are joined in a conventional manner to the spine 30. Cover C includes a rectangular sheet 36 formed of a flexible synthetic plastic material having a center portion 38 which adapted to abut the spine 30 of book B.

Figure 3:
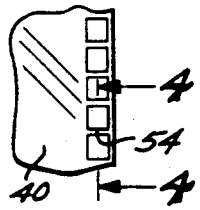
FIG. 3 is an enlarged view of the portion of the encircled portion of FIG. 1 designated 3.
Figure 5:
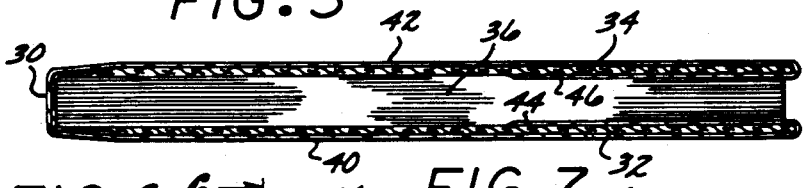
FIG. 5 is an enlarged top plan view of the book shown in FIG. 1.
Figure 6:
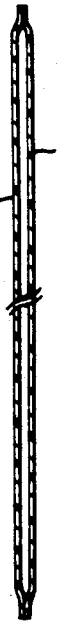
FIG. 6 is a broken, vertical sectional view taken in enlarged scale along line 6—6 of FIG. 7.
Figure 4:
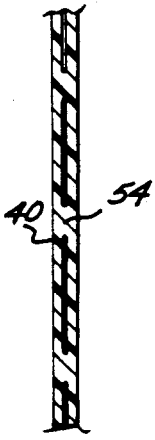
FIG. 4 is a vertical, sectional view in enlarged scale along lines 4—4 of FIG. 3.

The side portions 40 and 42 of the cover are folded inwardly at the edges of the spine 30 to overly the exterior surfaces of the front and rear covers 32 and 34 of the book. The cover C is also formed with front and rear inwardly-facing flaps 44 and 46 which engage the upper, lower and side edges 48, 50 of the front and rear covers of the book so as to removably receive the distal portions of said front and rear covers. The upper and lower borders of the inwardly-facing flaps 44 and 46 are sealed to thereby removably retain the wrap around cover on the book locked against vertical movement relative to the book. Referring to FIGS. 3 and 4, the front and rear flaps 44 and 46 are preferably heat bonded at their upper, lower and side edges to the rear outer portions of the rectangular sheet 36, in a conventional manner, as indicated by fused points 54.

Figure 7:
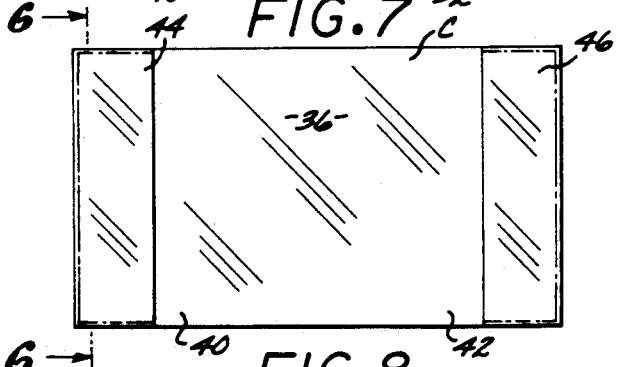
FIG. 7 is a front view of the wrap-around cover shown in FIGS. 1-5.

The cover C is easily installed upon book B by arranging the cover in its open position of FIG. 7 and inserting the outer portion of the front book cover 32 into flap 44. Thereafter, the front and rear book covers are bent open backwardly for the distance necessary to insert the rear book cover 634 within its flap 46. The cover C may be easily removed from its book by reversing this procedure.

Figure 8:
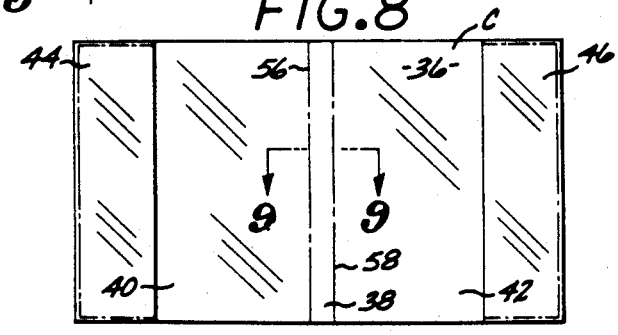
FIG. 8 is a view similar to FIG. 7, but showing a second form of said cover embodying the present invention.
Figure 9:
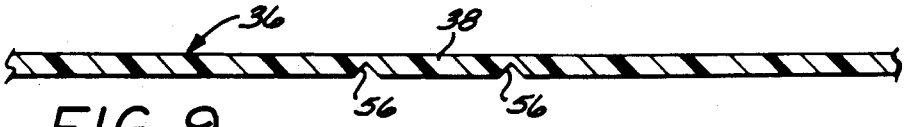
FIG. 9 is a horizontal, sectional view taken in enlarged scale along 9—9 of FIG. 8.

Referring now to FIGS. 8 and 9, the center portion 38 of the rectangular sheet 36 may be formed with a pair of vertical score lines 56 and 58 to provide a snug, square configuration of the center portion of the cover relative to the book spine 30 and thereby provide a neater and more attractive appearance for the covered book B.

Figure 10:
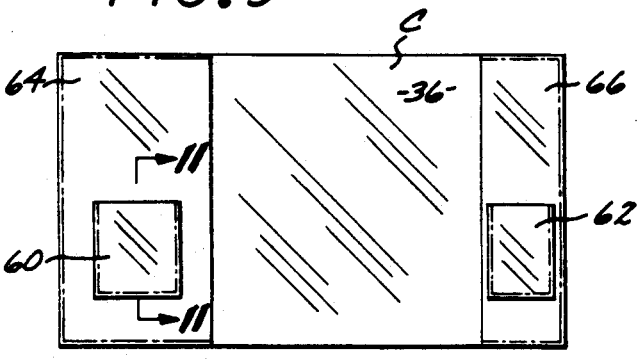
FIG. 10 is a view similar to FIG. 7, but showing a third form of wrap-around book cover embodying the present invention.
Figure 11:
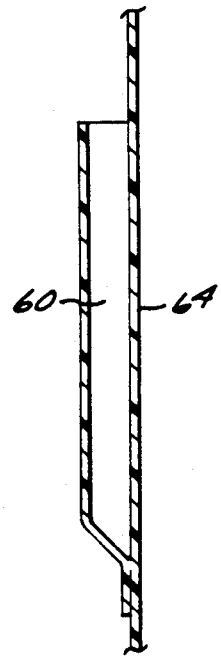
FIG. 11 is a vertical, sectional view taken in enlarged scale along line 11—11 of FIG. 9.
Figure 12:
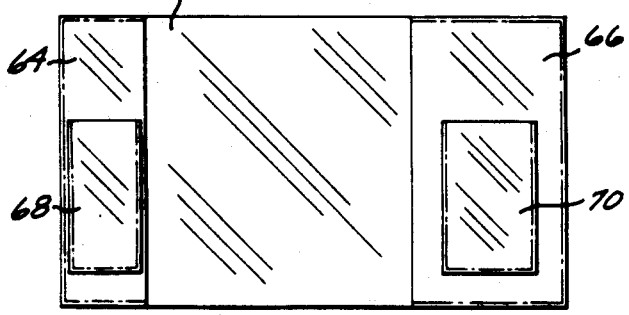
FIG. 12 is a view of a modified pocket arrangement for the cover of FIG. 10.
Figure 15:
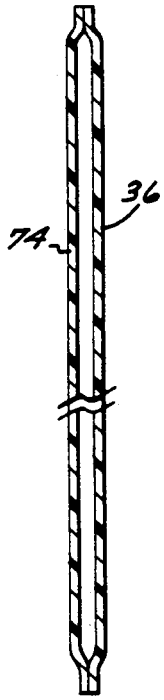
FIG. 15 is a vertical, sectional view taken in enlarged scale along line 15—15 of FIG. 12.
Figure 13:
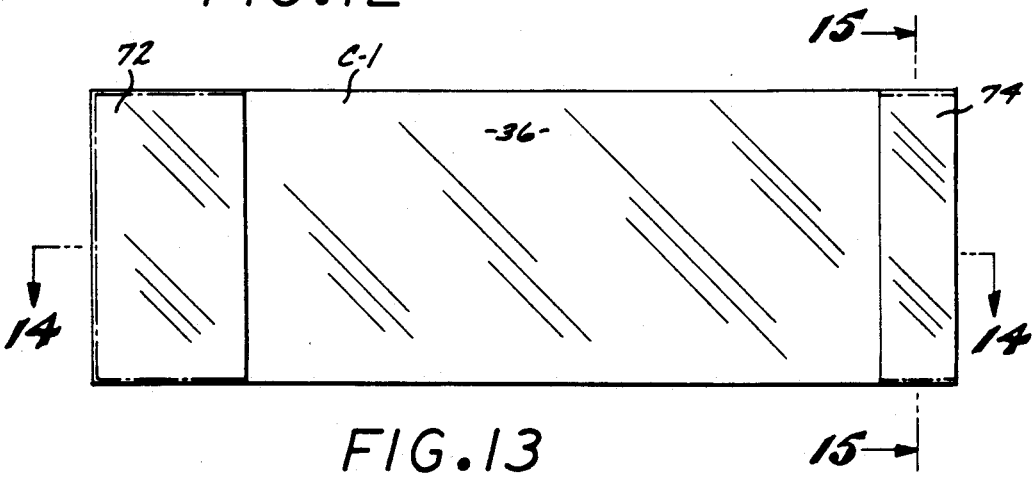
FIG. 13 is a view similar to FIG. 7, but showing a fourth form of wrap-around book cover embodying the present invention.

A wrap-around cover embodying the present invention may be readily provided with one or more pockets on the interior of the front and rear flaps. Such pockets are adapted to receive library cards or any other reference material such as conversion charts, rulers or the like. Thus referring to FIG. 10, there are shown front and rear pockets 60 and 62 suitably affixed to the interior of front and rear flaps 64 and 66 as by conventional heat bonding. The size and shape of such pockets can be easily varied to accommodate their contents. By way of example, in FIG. 12 there are shown front and rear packets 68 and 70 of elongated configuration compared to those shown in FIG. 10 heat bonded to front and rear flaps 64 and 66. The provision of these front and rear pockets eliminates the necessity for libraries to purchase conventional paper card envelopes and glue such envelopes inside the front and/or rear pages of the book.

Figure 14:
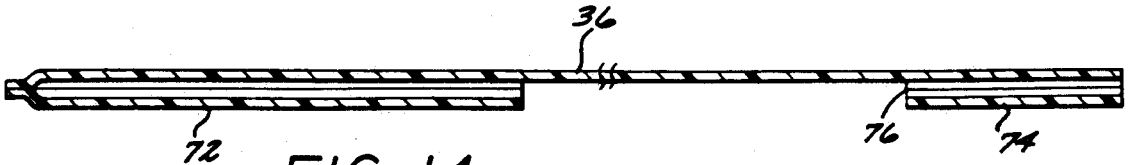
FIG. 14 is a broken horizontal, sectional view taken in enlarged scale along line 14—14 of FIG. 13.

It is an important feature of the present invention that the cover can be fitted to books of similar heights, but varying thickness. Thus, in FIGS. 13-16, there is shown a wrap-around cover C-1 having a height similar to the wrap-around cover shown in FIGS. 1-8, but having a greater length. The left portion of Cover C is provided with a front flap, 72 which is sealed along its upper, lower and side borders to the rectangular sheet 36. The rear flap 74, however, is seen to be sealed only along its upper and lower borders to the upper and lower edges of the outer portion of the rectangular sheet, with the vertical edge being open, as indicated at 76 in FIG. 14. Referring to FIG. 16, wrap-around cover C-1 is adapted for use on a book B-1 of greater thickness than the book B of FIG. 5. To install cover C-1 on book B-1, the outer portion of the front cover 78 of the book is inserted within front flap 72 of the front cover. The rectangular sheet is then folded over the spine 30 of the book and rear flap 74 is urged over the outer portion of the rear cover 80 of the book to the extent necessary to form a snug fit between the cover C-1 and the book B-1. It will be apparent that the thicker the book B-1, the less distance the rear flap 74 will extend inwardly over the rear cover of the book.

A wrap-around cover of the present invention can greatly reduce the inventory of book covers required for a book store or library, since a single size cover may be fitted to several sizes of books in a simple and expedient manner. Thus, referring to FIGS. 17, 18 and 19, there is shown a wrap-around cover C-2 of greater height than the covers shown in the preceding figures. Such cover C-2 may be fitted either to a book of the same height as the cover C-2 or to a book of a lesser height, as exemplified by book B-2 in FIG. 18. Cover C-2 is provided only with a front flap 84 which is heat sealed along its upper edge and the upper portion of its side edge to the upper front part of rectangular sheet 36, as indicated at 86 and 88. The rear end of the flexible sheet 36 is not initially provided with a separate rear flap. In FIG. 18, book B-1 is shown with its front cover 40 received within front flap 84 of the cover C-2. The lower portion of cover C-2 is then cut-off at 92 horizontally adjacent the lower edge of book B-2. Thereafter, the flexible sheet 36 is cut vertically as shown at 93 at a position outwardly of the opened rear cover 42 of book B-2 to define a rear flap 94. This rear flap 94 is then bent inwardly over the inner surface of the book's rear cover 42 to complete the covering procedure, as indicated in FIG. 19.

Figure 20:
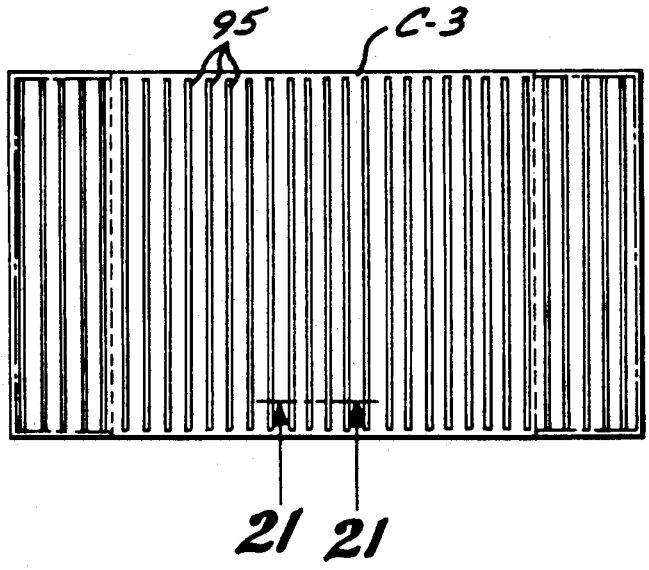
FIG. 20 is a front view of a scored wrap-around book cover of the present invention.
Figure 21:
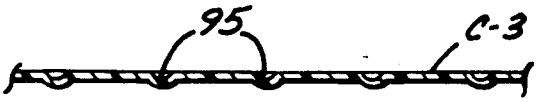
FIG. 21 is a horizontal sectional view taken along line 21—21 of FIG. 20.
Figure 22:
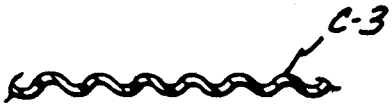
FIG. 22 is a view similar to FIG. 21 showing another type of scoring of the cover of FIG. 20.

Referring now to FIG. 20, there is shown a wrap-around cover C-3 formed with vertical ribbing all or a portion of its length, the ribs being indicated at 95 in FIGS. 20 and 21. Such ribbing configuration produces a bulkier feeling for the cover than a flat cover. It is therefor possible to utilize a thinner synthetic plastic sheet material to form the wrap-around cover and thereby lower the cost of the wrap-around cover. A ribbed wrap-around cove will also better absorb shocks during shipment of a book to thereby minimize the possibility of damage. In FIG. 22 the wrap-around cover is provided with a ribbed configuration by forming the synthetic plastic sheet with a corrugated shape.

If the wrap-around cover is formed of a transparent synthetic plastic material, printing on the front and rear covers of the book will be readily visible. Alternatively, the wrap-around cover may bear printing and artwork so as to be an actual part of the book it covers. By way of example, a wrap-around cover could totally black and unprinted or metallic, i.e. a cover which is difficult or impossible to print under normal conditions. Such cover could bear white ink for the title to provide a sticking appearance. It should also be noted that the synthetic plastic material could be formulated with a conventional ultra violet protection element to inhibit discoloration of the book covers. Additionally, the wrap-around cover can be formulated with a conventional plasticizer to obtain flexibility of the cover in cold temperatures and thereby avoid cold cracking of the wrap-around cover.

Various modifications and changes be made with respect to the foregoing detailed description without departing from the spirit of the present invention.

I claim:

1. A protective wrap-around cover for a bound book having a spine, from the front and a rear edges of which spine extend front and rear book covers, said book covers having distal portions spaced outwardly of said spine, respectively, said wrap-around cover comprising:

a rectangular sheet initially of greater height than the height, and width of the bound book when the book is opened, said sheet having a center portion that abuts said spine, said sheet also having front and rear side portions extending outwardly from said center portion to overlie the exterior of the front and rear book covers, said sides being folded inwardly to define inwardly-facing front and rear flaps on the outer parts of the side portions, said front flap being sealed to the cover's front side portion only along the upper edge of said front flap and the upper edge of the cover's side portion, said rear flap initially extending sidewards a distance greater than the rear cover of the bound book;

whereby to fit the protective cover to the bound book, the front book cover is inserted within the front flap, the lower portion of the rectangular sheet is cut off horizontally adjacent the lower edge of the bound book, the rear side portion of the rectangular sheet is cut off vertically outwardly of the side edge of the rear book cover and the area of the sheet outwardly of the rear book cover is bent inwardly over the rear book cover to define the rear flap of the protective book cover; and with said rectangular sheet being formed of a single layer of a flexible transparent synthetic plastic material through which printing on the bound book covers is visible through the wrap-around cover.

2. A protective wrap-around cover as set forth in claim 1 wherein said center portion is defined by a pair of scores separated by the approximate thickness of the largest thickness of the book upon which it is to be applied to provide a snug, square configuration for said center portion.

3. A protective wrap-around cover as set forth in claim 1 wherein vertical ribbing is formed over the entire surface of the rectangular sheet to enhance the feeling of bulk of the protective cover.

4. A protective wrap-around cover as set forth in claim 1 wherein pocket means are formed on one or both of the front and rear flaps.

* * * * *